US008265316B2

(12) United States Patent
Saltykov et al.

(10) Patent No.: US 8,265,316 B2
(45) Date of Patent: Sep. 11, 2012

(54) HEARING AID WITH ENHANCED VENT

(75) Inventors: Oleg Saltykov, Fairlawn, NJ (US); Fred McBagonluri, East Windsor, NJ (US)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1210 days.

(21) Appl. No.: 12/052,247

(22) Filed: Mar. 20, 2008

(65) Prior Publication Data

US 2009/0238388 A1 Sep. 24, 2009

(51) Int. Cl.
*H04R 25/00* (2006.01)

(52) U.S. Cl. ..... 381/325

(58) Field of Classification Search ..... 381/324–325, 381/322

See application file for complete search history.

(56) References Cited

U.S. PATENT DOCUMENTS

| | | | | |
|---|---|---|---|---|
| 4,972,488 | A * | 11/1990 | Weiss et al. | 381/325 |
| 6,105,713 | A * | 8/2000 | Brimhall et al. | 181/135 |
| 6,134,333 | A * | 10/2000 | Flagler | 381/325 |
| 6,164,409 | A * | 12/2000 | Berger | 181/135 |
| 6,626,822 | B1 * | 9/2003 | Jaeger et al. | 600/25 |
| 7,983,434 | B2 * | 7/2011 | Rohrlein | 381/322 |
| 2005/0018866 | A1 | 1/2005 | Schulein et al. | |
| 2007/0206826 | A1 * | 9/2007 | Rohrlein | 381/325 |
| 2008/0063228 | A1 | 3/2008 | Mejia et al. | |
| 2008/0095390 | A1 * | 4/2008 | Gebert et al. | 381/323 |

FOREIGN PATENT DOCUMENTS

| | | |
|---|---|---|
| WO | WO 92/21218 | 11/1992 |
| WO | 2006037156 | 4/2006 |
| WO | 2006108099 | 10/2006 |

OTHER PUBLICATIONS

Gerald A Studebaker, "The Acoustical Effect of Various Factors on the Frequency Response of a Hearing-Aid Receiver", Journal of the Audio Engineering Society, New York, NY, vol. 22, No. 5, Jun. 1, 1974, pp. 329-334.

Mejia, J., et al., "Active Cancellation of Occlusion: An Electronic Vent for Hearing Aids and Hearing Protectors", J Accoust. Soc. Am. 124(1), Jul. 2008, pp. 235-240.

Knowles Electronics, Inc. Technical Bulletin, TB5, "Walk Induced Head Vibrations and Hearing Aid Design", http://www.knowles.com/search/pdf/TB-05.pdf, downloaded on Jul. 5, 2001, pp. 1-4.

Ingard et al., "The Impedance of a Resistance Loaded Helmholtz Resonator", Journal of the Acoustical Society of America, Melville, NY, vol. 25, No, 5, Sep. 1, 1953, pp. 854-857.

International Search Report including Notification of Transmittal of the International Search Report, International Search Report, and Written Opinion of the International Searching Authority, PCT/US2008/013703 2009.

* cited by examiner

*Primary Examiner* — Elvin G Enad
*Assistant Examiner* — Andrew R Millikin
(74) *Attorney, Agent, or Firm* — Francis G Montgomery

(57) ABSTRACT

A hearing aid with a microphone for receiving acoustic signals and converting them to electrical signals, electronic circuitry for processing the electrical signals, and a speaker for converting the processed electrical signals into acoustic signals, has a shell that encases at least portions of the microphone, the electronic circuitry, and the speaker, the shell further encasing an inside volume. The hearing aid further has a vent that provides an opening between the inside volume and a region external to the hearing aid. A flexible membrane is provided that covers an opening of the vent and an acoustic resistor that contacts the flexible membrane. The membrane helps prevent wax fumes from entering the inside volume, and the acoustic resistor helps to reduce distortion in the frequency response of the hearing aid.

8 Claims, 2 Drawing Sheets

HEARING AID WITH ENHANCED VENT

BACKGROUND

The present invention relates to a hearing aid, and specifically to a hearing aid having an enhanced vent that produces sound having beneficial characteristics.

A custom hearing aid typically includes a vent. The main purpose of the vent is to reduce the "occlusion" effect, which is defined as an unpleasant sensation related to a loud sound of the hearing aid user's voice. The occlusion sound is generated due to vibrations of the ear canal tissues that are generated, e.g., when the wearer speaks.

The intensity of the occlusion sound is drastically increased when a hearing aid user inserts the aid into the ear. This is because the hearing aid blocks the ear canal, thereby forming a closed volume around the ear drum. When this happens, the sound pressure, caused by vibrations of the canal tissues, increases to levels that make it very annoying to the hearing aid users.

In conventional hearing aid designs, a conventional vent forms a passage for the ear from the closed volume near the ear drum to the outside space, thereby allowing a reduction of the occlusion effect. FIG. 3 illustrates the frequency response of a hearing aid with a conventional vent design.

One negative effect of such a vent, however, is to increase the occurrence of an acoustic feedback by letting the amplified sound pressure from the ear canal enter into the microphone, thereby creating a feedback loop. A hearing aid with a vent has a limited stable gain that is determined by the vent cross-section area, vent length, and the distance between the vent opening and the microphone inlet.

The prior art International patent publication WO 92/21218 ("Gauthier") illustrates a known hearing aid design (see FIG. 1), showing a microphone 10, receiver (speaker) 12, various electrical components 14, 16, 18, and 20 mounted on a printed circuit board 22, a battery housed in a battery compartment 24, and wires 26 running from the printed circuit board 22 to the speaker 12. The speaker has a sound conducting tube 28 that opens to the ear canal of the user.

Gauthier discloses a vent construction that allows an increase in the stable gain of a hearing aid. The hearing aid has a housing 30 that has an air vent passage 32 extending along the length of the housing and conducts sound from the ear canal to outside of the ear. Gauthier's modified vent (referred to as a "tuned passage") 42 has an opening from the vent 32 into the inside volume 38 of the hearing aid.

However, the vent construction of Gauthier has the following disadvantages:

1. Due to the resonance effects of the Helmholtz resonator that is formed by the opening 42 and the inside volume 38, the frequency response of the hearing aid becomes strongly distorted. In addition to the expected reduction of the gain at low frequencies (due to leaks of sound energy through the vent), the response developed is illustrated in FIG. 4. Also the increased sound pressure inside the shell 38 leaks into the microphone 10 inlet via the gaps in the battery door, creating another feedback path and causing peaks in the response curve near the 1-3 kHz frequency range, as is illustrated in FIG. 4.
2. The wax fumes go through the opening 42 into the inside of the hearing aid 38 and create wax deposits causing corrosion and a consequential malfunction of the electronic parts of the hearing aid.

SUMMARY

The invention is directed to a hearing aid, comprising, according to various embodiments: a microphone for receiving acoustic signals and converting them to electrical signals; electronic circuitry for processing the electrical signals; a speaker for converting the processed electrical signals into acoustic signals; a shell that encases at least portions of the microphone, the electronic circuitry, and the speaker, the shell further encasing an inside volume; a vent that provides an opening between the inside volume and a region external to the hearing aid; a flexible membrane that covers an opening of the vent; and an acoustic resistor that covers the flexible membrane on the side of hearing aid components.

DESCRIPTION OF THE DRAWINGS

The invention is described with reference to a preferred embodiment illustrated in the Figures and described in more detail below.

DETAILED DESCRIPTION OF THE PREFERRED EMBODIMENTS

Figure 1:
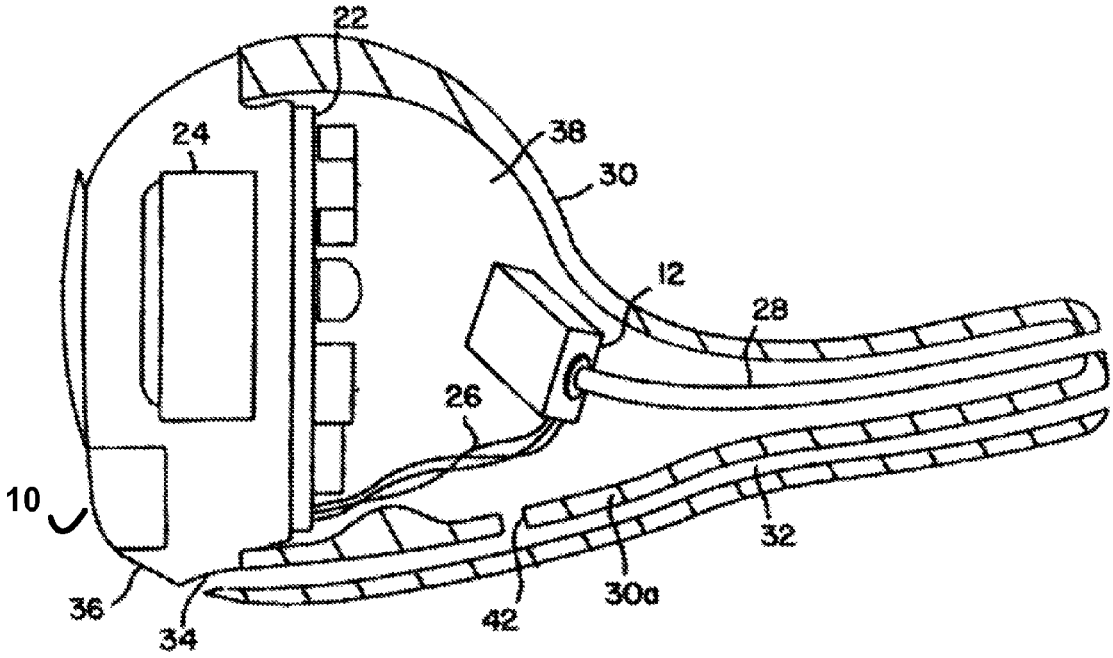
FIG. 1 (PRIOR ART)
FIG. 1 is a pictorial illustration of a hearing aid having a vent construction known in the prior art of Gauthier.
Figure 2:
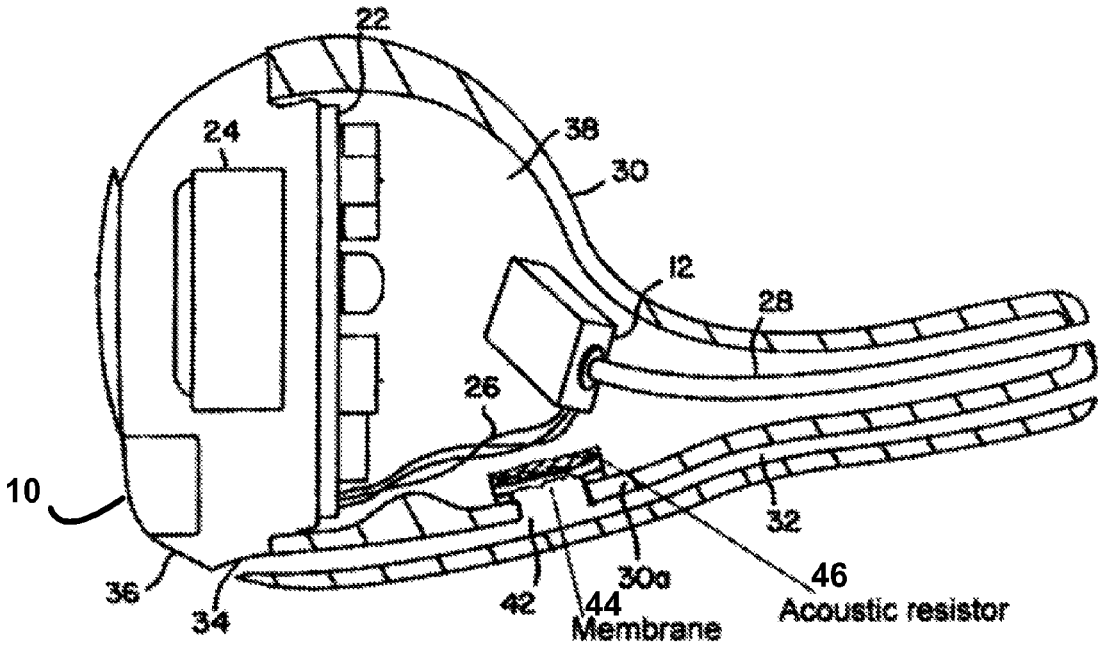
FIG. 2 is a pictorial illustration of a hearing aid according to an embodiment of the present invention.
Figure 3:
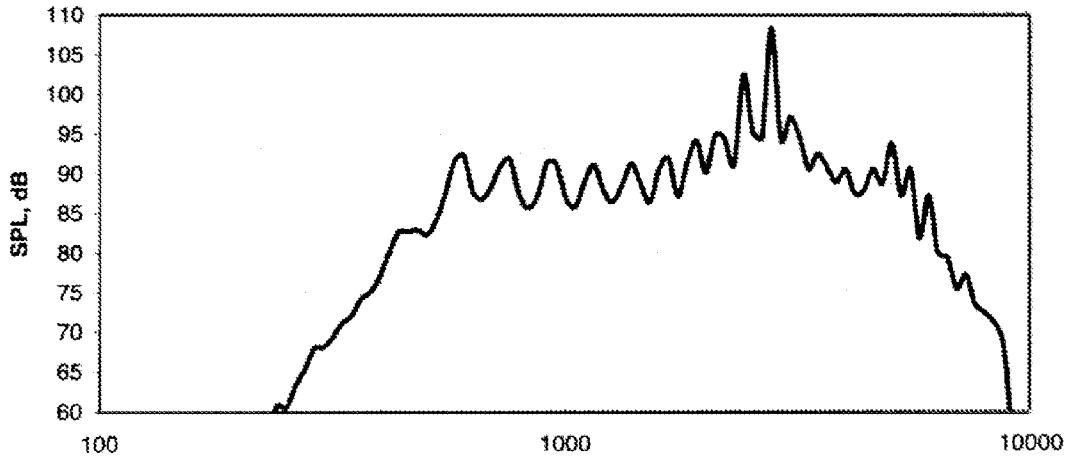
FIG. 3 (PRIOR ART)
FIG. 3 is a graph of the frequency response of a conventional hearing aid design.
Figure 4:
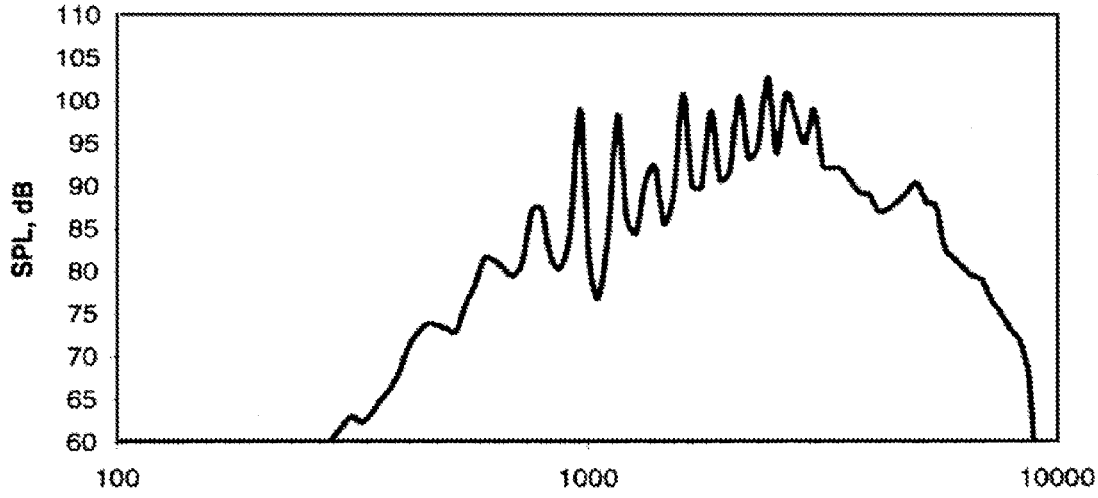
FIG. 4 (PRIOR ART)
FIG. 4 is a graph of the frequency response of the hearing aid disclosed in the prior art of Gauthier.

FIG. 2 illustrates an embodiment of the present inventive hearing aid design. As with the design of Gauthier, FIG. 2 shows a microphone 10, speaker 12, various electrical components 14, 16, 18, and 20 mounted on a printed circuit board 22, a battery housed in a battery compartment 24, and wires 26 running from the printed circuit board 22 to the speaker 12. The speaker has a sound conducting tube 28 that opens to the ear canal of the user.

According to this embodiment, however, the enhanced vent 32 includes an opening in the vent 42 that is covered with a small flexible membrane 44. This membrane 44 allows the sound from the vent 42 to go into the inside volume 38 of the hearing aid while protecting it from the wax fumes.

The membrane 44 used may be of a type described in U.S. Patent Publication No. 2005/0018866, herein incorporated by reference, and behaves like a very thin non-stretched film that re-radiates sound pressure on one side to the other side without substantial losses.

Figure 5:
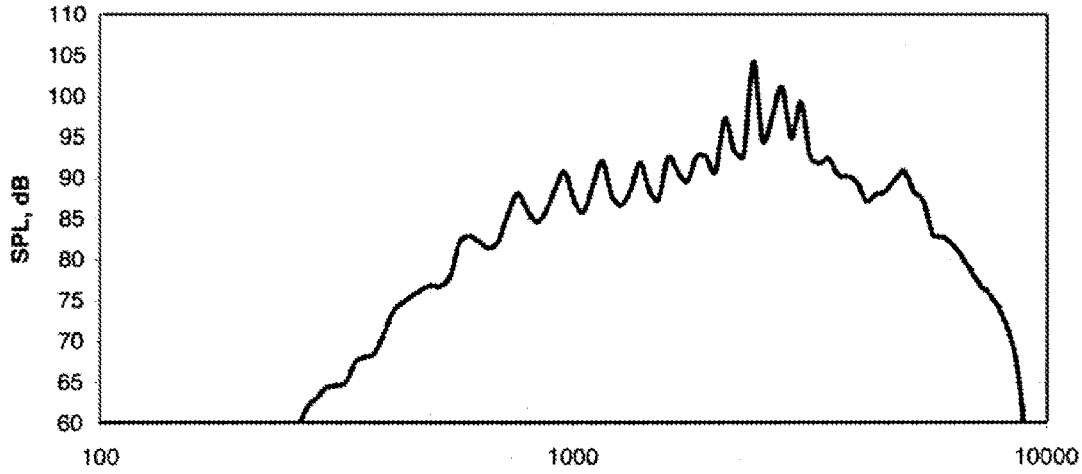
FIG. 5 is a graph of the frequency response of an embodiment of the present hearing aid.

The opening also may include an acoustic resistor 46 in the form of, e.g., a stretched tight cloth, a tight metal mesh, etc, that is positioned between the membrane 44 and the inside volume 38 of the hearing aid. The acoustic resistor 46 allows the hearing aid to obtain a smooth response of the vented hearing aid and to achieve higher stable gain and better occlusion reduction, as illustrated in the frequency response curve shown in FIG. 5.

By way of example, in a preferred embodiment, the acoustic resister for the system described herein has a resistance in the range of 50-200 acoustic ohms, with a practical membrane having a diameter of 3 mm. Such membrane type devices for the protection of receivers from ear wax are disclosed in U.S. Patent Publication 2005/0018866. A typical range of vent diameters is within 1-3 mm.

For the purposes of promoting an understanding of the principles of the invention, reference has been made to the preferred embodiments illustrated in the drawings, and specific language has been used to describe these embodiments.

However, no limitation of the scope of the invention is intended by this specific language, and the invention should be construed to encompass all embodiments that would normally occur to one of ordinary skill in the art.

The particular implementations shown and described herein are illustrative examples of the invention and are not intended to otherwise limit the scope of the invention in any way. For the sake of brevity, conventional aspects may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". The word mechanism is intended to be used generally and is not limited solely to mechanical embodiments. Numerous modifications and adaptations will be readily apparent to those skilled in this art without departing from the spirit and scope of the present invention.

What is claimed is:

1. A hearing aid, comprising:

a microphone for receiving acoustic signals and converting them to electrical signals;

electronic circuitry for processing the electrical signals;

a speaker for converting the processed electrical signals into acoustic signals;

a shell that encases at least portions of the microphone, the electronic circuitry, and the speaker, the shell further encasing an inside volume;

a vent with an opening in the vent into the inside volume of the hearing aid shell;

a flexible membrane that covers the opening in the vent into the inside volume of the hearing aid shell; and an acoustic resistor that covers the flexible membrane on the side of hearing aid components.

2. The hearing aid according to claim 1, wherein the flexible membrane separates the vent from the inside volume.

3. The hearing aid according to claim 1, wherein the flexible membrane has a diameter of approximately 3 mm.

4. The hearing aid according to claim 1, wherein the acoustic resistor is a stretched tight cloth.

5. The hearing aid according to claim 1, wherein the acoustic resistor is a tight metal mesh.

6. A hearing aid, comprising:

a microphone for receiving acoustic signals and converting them to electrical signals;

electronic circuitry for processing the electrical signals;

a speaker for converting the processed electrical signals into acoustic signals;

a shell that encases at least portions of the microphone, the electronic circuitry, and the speaker, the shell further encasing an inside volume;

a vent with an opening in the vent into the inside volume of the hearing aid shell;

a flexible membrane that covers the opening in the vent into the inside volume of the hearing aid shell; and an acoustic resistor that covers the flexible membrane on the side of hearing aid components;

wherein the acoustic resistor provides gain stability and smoother frequency response for the hearing aid over a design that does not include the acoustic resistor.

7. A hearing aid, comprising:

a microphone for receiving acoustic signals and converting them to electrical signals;

electronic circuitry for processing the electrical signals;

a speaker for converting the processed electrical signals into acoustic signals;

a shell that encases at least portions of the microphone, the electronic circuitry, and the speaker, the shell further encasing an inside volume;

a vent with an opening in the vent into the inside volume of the hearing aid shell;

a flexible membrane that covers the opening in the vent into the inside volume of the hearing aid shell; and an acoustic resistor that covers the flexible membrane on the side of hearing aid components;

wherein the membrane behaves like a very thin non-stretched film that re-radiates sound pressure on one side to its other side without substantial losses.

8. The hearing aid according to claim 1, wherein the acoustic resistor has a resistance in a range of 50-200 acoustic ohms.

* * * * *